US006959511B2

(12) United States Patent
Johnson et al.

(10) Patent No.: US 6,959,511 B2
(45) Date of Patent: Nov. 1, 2005

(54) LOCKABLE PET DOOR

(75) Inventors: Ryan E. Johnson, Dawsonville, GA (US); Kurt J. Steinbacher, Knoxville, TN (US); William S. Groh, Knoxville, TN (US)

(73) Assignee: Radio Systems Corporation, Knoxville, TN (US)

( * ) Notice: Subject to any disclaimer, the term of this patent is extended or adjusted under 35 U.S.C. 154(b) by 0 days.

(21) Appl. No.: 10/374,859

(22) Filed: Feb. 25, 2003

(65) Prior Publication Data

US 2004/0163316 A1 Aug. 26, 2004

(51) Int. Cl.[7] ..... E05D 15/48
(52) U.S. Cl. ..... 49/169; 160/180
(58) Field of Search ..... 49/169, 394, 326; 292/50, 48, 196, 235; 160/116, 180

(56) References Cited

U.S. PATENT DOCUMENTS

| | | | | |
|---|---|---|---|---|
| 2,293,363 A | | 8/1942 | Schell | |
| 3,978,616 A | | 9/1976 | Pennock | |
| 4,216,743 A | | 8/1980 | Cohen | |
| 4,421,058 A | * | 12/1983 | Paul | 119/484 |
| 4,760,872 A | | 8/1988 | Hale, Jr. | |
| 4,776,133 A | * | 10/1988 | Green | 49/394 |
| 5,469,659 A | * | 11/1995 | Reid et al. | 49/169 |
| 5,535,804 A | | 7/1996 | Guest | |
| 5,701,702 A | * | 12/1997 | Reid et al. | 49/169 |
| 5,967,215 A | | 10/1999 | Needham et al. | |
| 6,297,739 B1 | | 10/2001 | Small | |
| 6,385,909 B1 | * | 5/2002 | Marsh et al. | 49/169 |

FOREIGN PATENT DOCUMENTS

GB 2305211 A * 4/1997 ..... E05B/49/00

* cited by examiner

*Primary Examiner*—Jerry Redman
(74) *Attorney, Agent, or Firm*—Pitts & Brittian, P.C.

(57) ABSTRACT

A pet door offering ingress or egress through a structural member. A lock mechanism in the pet door allows the pet owner to restrict ingress and/or egress as desired. The pet door features a dual control system that simplifies the setting of the lock. Each control corresponds to movement of the flap in one direction. The dual control system is also designed to be easier to access than a conventional pet door lock mechanism and to be less susceptible to unintentional adjustment resulting from incidental contact with the controls.

11 Claims, 5 Drawing Sheets

LOCKABLE PET DOOR

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of Invention

This invention pertains to a lockable pet door. More particularly, this invention pertains to a pet door having a lock mechanism to restrict ingress and egress through the pet door as desired by the pet owner.

2. Description of the Related Art

A pet door allows a pet to independently enter and exit a structure. A standard pet door is installed in an opening cut into a structural member, such as a door or wall. It is desirable for a pet door to provide the owner the ability to restrict ingress and/or egress.

Various lock mechanisms have been utilized to secure a pet door. For example, one commonly used locking mechanism involves lock control, typically a knob or slide, located below the pet door opening which moves a series of tabs into engagement with a flap to block movement in a desired direction. Such an arrangement requires careful attention to ensure that the flap is locked so that travel is restricted in the desired direction. Further, due to the placement of the lock control, it is not easily accessible. The low placement of the lock control presents a hardship for pet owners with limited mobility or disabilities. The low placement of the lock controls subjects them to unintended manipulation, such as by incidental contact with the pet as the pet passes through the portal. This can result in the pet accidentally locking the pet door.

Another commonly utilized locking mechanism is a latch which is released by a magnetic key. However, such a lock mechanism requires pet owners to provide a key to each animal. If the key is lost, such as when the collar becomes snagged and breaks, then the pet can not access the pet door. Further, the latch mechanism requires further intelligence or a separate manual control, if directional control is desired in addition to key carrier control.

Accordingly, it is desirable to provide a pet door with a locking mechanism to restrict ingress and egress and for that locking mechanism to be less susceptible to unintended actuation by a pet and more convenient for the pet owner to operate.

BRIEF SUMMARY OF THE INVENTION

A pet door according to the present invention is shown and described. The pet door provides offers ingress or egress through a structural member, such as a wall or door, to a pet. A lock mechanism in the pet door allows the pet owner to restrict ingress and/or egress as desired. The pet door features a dual control system that simplifies the setting of the lock. Each control corresponds to movement of the flap in one direction. The dual control system is also designed to be easier to access than conventional pet door lock mechanism. Further, the dual control system is designed to be less susceptible to unintentional adjustment resulting from incidental contact with the controls.

The pet door includes two cooperating frame members that encompass an opening in a generally planar structural member. The frame members include a passageway shelf bounding a passageway coinciding with the opening in the structural member. A flap is adapted to fit within the passageway such that a generally weather-tight seal is formed. The flap is pivotably connected to one of the frame members such that the flap can freely swing within the passageway to provide both ingress and egress. The flap is considered a hard flap meaning that the flap is generally rigid and does not exhibit significant flexing in any dimension. By using a hard flap, movement of the flap occurs only when the unconnected edges are not restricted in any manner.

The pet door includes two controls that cooperate to permit or restrict the movement of the flap as desired by the owner. Operating independently, each control permits or restricts movement of the flap in one direction. By actuating the appropriate control, access through the pet door can be restricted such that a pet may exit but not enter or, in the alternative, enter but not exit. Together, the controls can be set to permit the flap to move freely in both directions or to restrict the flap moving in either direction, effectively locking the pet door.

The controls are generally located above the passageway. This makes the operation of the lock mechanism much more accessible to the pet owner than conventional controls that are integrated with the lock mechanism they operate and positioned at the bottom of the pet door, below the passageway. By placing the controls above the passageway, the animal using the pet door is unlikely to make incidental contact with the controls. This reduces or altogether eliminates unintentional adjustment of the pet owner's desired ingress and egress restrictions.

In addition, the lock mechanism includes a pair of bolts, each bolt connected to one of the controls via a linkage. The bolt is adapted to be move in and out of engagement with the flap and also a socket included in the flap. The locking mechanism generally operates in the following manner. As one of the controls is actuated, the linkage moves forcing the bolt to move. In a first position, the bolt is retracted and does not engage or otherwise obstruct movement of the flap. Moving the control to a second position results in the bolt engaging the flap but not the socket. In this position the flap is prevented from swinging in one direction while remaining free to swing in the opposite direction. When the control is moved to a third position, the bolt engages the socket effectively preventing the flap from swinging in either direction thereby restricting both ingress and egress.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A pet door according to the present invention is shown and described generally at 10 in the figures. The pet door 10 provides offers ingress or egress through a structural member, such as a wall, a door, or other element commonly used in construction, to a pet. A lock mechanism in the pet door 10 allows the pet owner to restrict ingress and/or egress as desired. The pet door 10 features a dual control system that simplifies the setting of the lock. Each control corresponds to movement of the flap in one direction. The dual control system is also designed to be easier to access than conventional pet door lock mechanism. Further, the dual control system is designed to be less susceptible to unintentional adjustment resulting from incidental contact with the controls.

Figure 1:
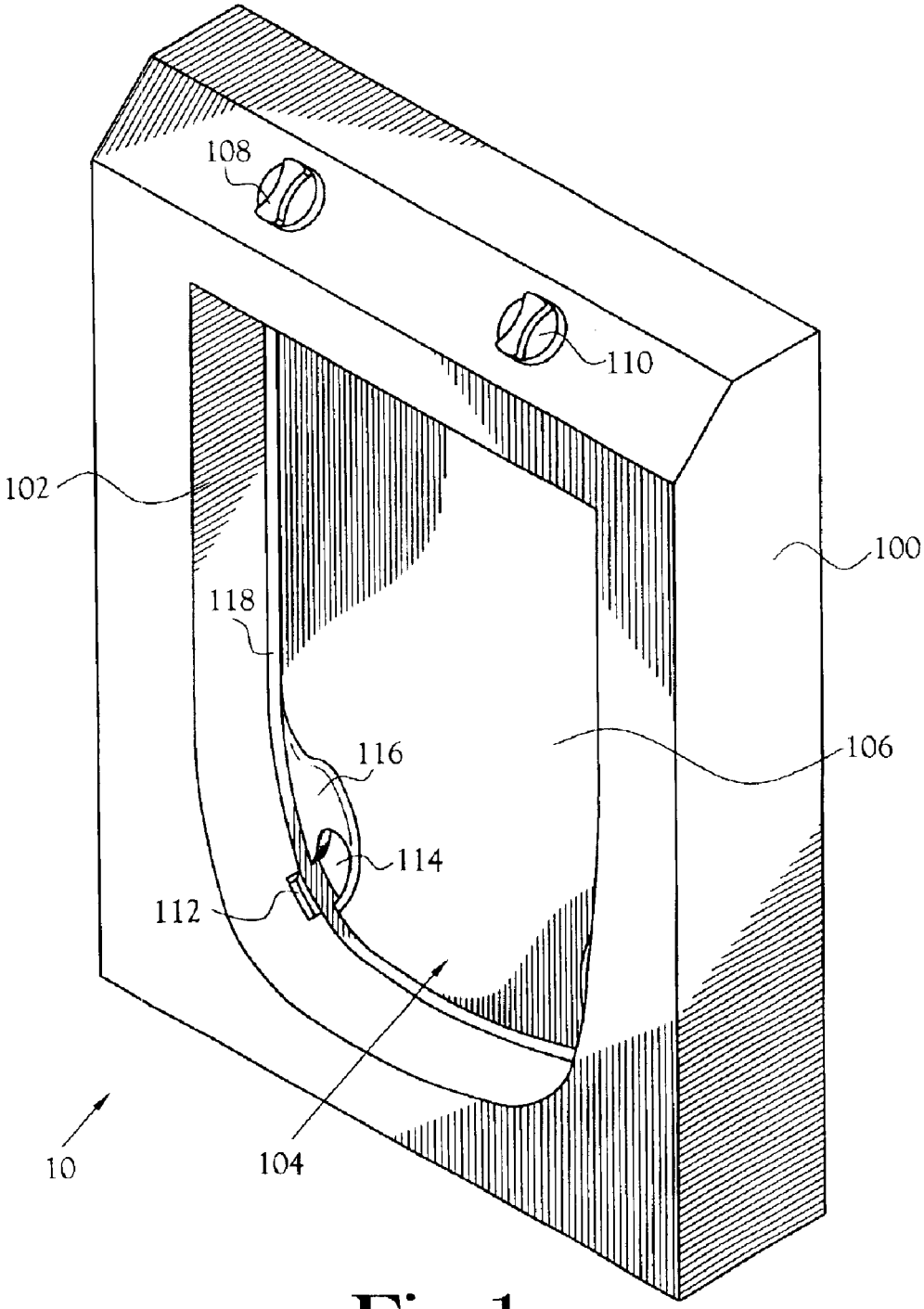
FIG. 1 is a front perspective view of a pet door incorporating the lock mechanism of the present invention.
Figure 2:
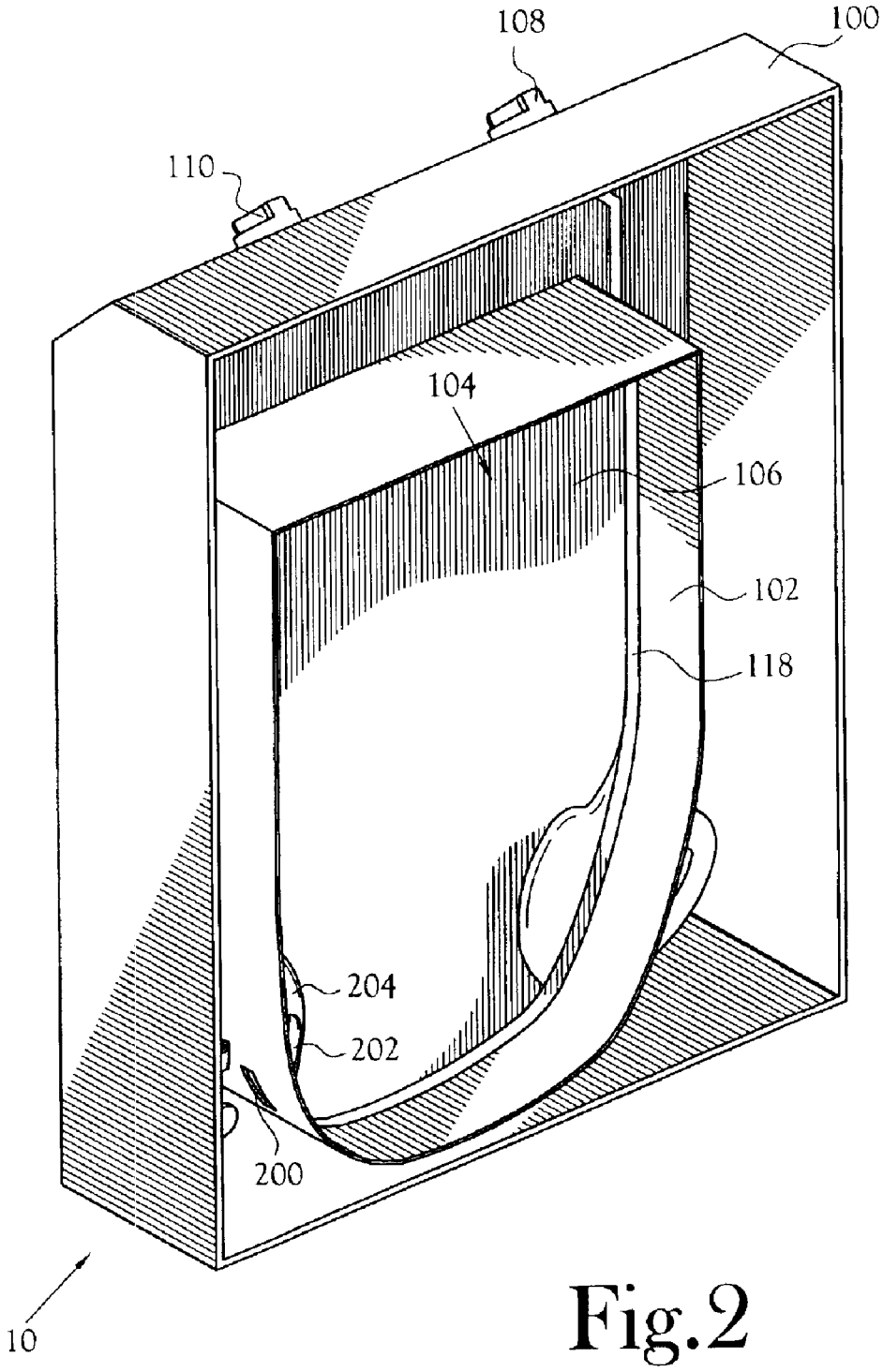
FIG. 2 is a rear perspective view of a pet door incorporating the lock mechanism of the present invention.

FIG. 1 illustrates the normally visible face of the pet door 10 when the pet door is installed. FIG. 2 illustrates a face of the pet door 10 that is concealed from view when the pet door is installed. The pet door 10 includes an inner frame member 100 that cooperates with an outer frame member (not shown) to encompass an opening in a generally planar structural member (not shown). The frame members include a passageway shelf 102 bounding a passageway 104 coinciding with the opening in the structural member. A flap 106 is adapted to fit within the passageway 104. The flap 106 includes a perimeter gasket 118 such that when in a closed position, a generally weather-tight seal is formed between the gasket 118 and the passageway shelf 102. The flap 106 is pivotably connected to the inner frame member 100 such that the flap 106 can freely swing within the passageway 104 to provide both ingress and egress. The flap 106 is considered a hard flap meaning that the flap 106 is generally rigid and does not exhibit significant flexing in any dimension. By using a hard flap, movement of the flap 106 occurs only when the unconnected edges are not restricted in any manner. The various mechanisms for the installation and the general operation of pet doors are well-known to those skilled in the art. Any pet door incorporating the features hereinafter described and claimed is deemed to be within the purview of those skilled in the art. Further, while the features of the present invention are generally described in reference to the inner frame member 100, those skilled in the art will recognize that, in most instances, either frame member could be used.

Visible on the face of the inner frame member are two controls 108, 110. The two controls 108, 110 cooperate to permit or restrict the movement of the flap 106 as desired by the owner. Operating independently, each control 108, 110 permits or restricts movement of the flap 106 in one direction. By actuating the appropriate control 108, 110, access through the pet door can be restricted such that a pet may exit but not enter or, in the alternative, enter but not exit. Together, the controls 108, 110 can be set to permit the flap to move freely in both directions or to restrict the flap 106 from moving in either direction, effectively locking the pet door. The passageway shelf 102 defines a pair of slots through which the locking mechanism can pass to engage the flap 106. Visible in FIG. 1 is the ingress lock slot 112, the ingress lock channel 114, and the ingress lock socket 116. In the illustrated embodiment, the ingress lock socket 116 is included in a raised area on the face of the flap 106. The ingress lock channel 114 serves as a guide to the opening of the ingress lock socket 116. Located on the opposing face of the flap 106, the egress lock slot 200, the egress lock channel 202, and the egress lock socket 204 are visible in FIG. 2.

The controls 108, 110 are generally located at the top of the inner frame member 100 above the passageway 104. This makes the operation of the lock mechanism much more accessible to the pet owner than conventional controls that are positioned at the bottom of the pet door below the passageway, which typically are integrated with the lock mechanism they operate. If the dimensions of the inner frame member 100 are appropriately extended, the controls 108, 110 for the lock mechanism of the present invention can be located a substantial distance above the lock mechanism allowing a lockable pet door 10 to be constructed that is operable without stooping or bending. Furthermore, by placing the controls 108, 110 above the passageway 104, the animal using the pet door 10 is unlikely to make incidental contact with the controls 108, 110. This reduces or altogether eliminates unintentional adjustment of the pet owner's desired ingress and egress restrictions.

Figure 3:
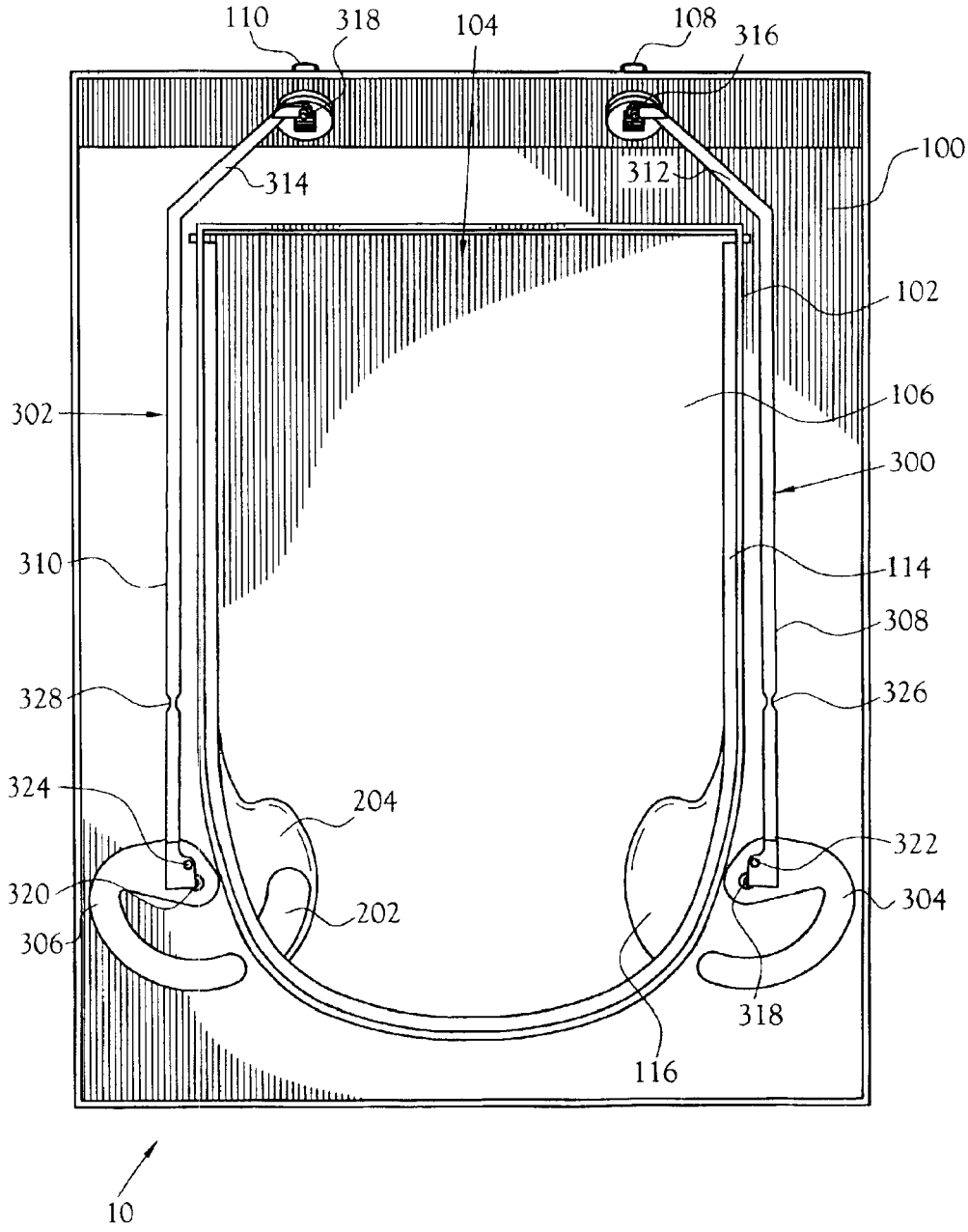
FIG. 3 is a rear elevation view of a pet door incorporating the lock mechanism of the present invention.

FIG. 3 is a rear elevation view of the inner frame member 100. The components of one embodiment the lock mechanism are clearly visible. Each control 108, 110 is connected to a corresponding bolt 304, 306 via a linkage 300, 302. The bolt 304, 306 is adapted to be move in and out of engagement with the flap 106. Specifically, each bolt 304, 306 is adapted to pass through the lock slots 112, 200 and engage the flap lock sockets 116, 204. In the illustrated embodiment, each bolt 304, 306 is a cam-shaped member rotatably connected to the inner frame member 100 at a frame connector 318, 320. The bolts 304, 306 are constructed out of a high strength material, typically a metal such as steel, to resist bending or breaking.

In one embodiment, each linkage 300, 302 is a substantially rigid member extending between the control 108, 110 and the bolt 304, 306 with a cross-section designed to provide the desired rigidity and strength. Each linkage 300, 302 has two sections, one of which being a first elongated member 308, 310 extending the substantial height of the inner frame member 100. Each first elongated member 308, 310 is attached to the corresponding bolt 304, 306 at one end and is joined with a second elongated member 312, 314, which is disposed substantially orthogonal to the first elongated member 308, 310. Those skilled in the art will recognize that the first elongated members 308, 310 and the second elongated members 312, 314 can be integrally formed or separate pieces combined in a manner known to those skilled in the art. The various methods of securing the linkage to both the controls and the bolt are considered to be within the purview of those skilled in the art and can be designed and implemented without undue experimentation.

The locking mechanism generally operates in the following manner. Each control 108, 110 includes an eccentrically located connector 316, 318 to which one end of the second elongated member 312, 314 is secured. Similarly, each first elongated member 308, 310 connects to the corresponding bolt 304, 306 at a linkage connector 322, 324, which is eccentrically located relative to the frame connector 318, 320. As the control 108, 110 is actuated, the linkage 300, 302 moves forcing the bolt 304, 306 to rotate about the frame connector 318, 320. In a first position, the bolt 304, 306 is fully retracted and does not engage or otherwise obstruct movement of the flap 106. Moving the control 108, 110 to a second position results in the bolt 304, 306 engaging the flap 106 but not the socket 116, 204. In this position the flap 106 is prevented from swinging in one direction while remaining free to swing in the opposite direction. When the control 108, 110 is moved to a third position, the bolt 304, 306 engages the socket 116, 204 effectively preventing the flap 106 from swinging in either direction thereby restricting both ingress and egress. The operation of the locking mechanism is more fully described in reference to FIGS. 5, 6, and 7.

Another feature of the rigid linkage 300, 302 illustrated in FIG. 3 is the incorporation of a hinge 326, 328 into the first elongated member 308, 310. This hinge 326, 328 is designed to provide a limited amount of flexibility in the linkage 300, 302 to relieve pressure as the linkage control 108, 110 is operated.

Each raised area, together with the corresponding face of the flap 106, define the lock socket 116, 204 adapted to receiving the corresponding bolt 304, 306. Each raised area and corresponding flap face 106 also define the channel 114, 202, which serves to help guide the bolt 304, 306 into the opening of the socket 199, 299.

Figure 4:
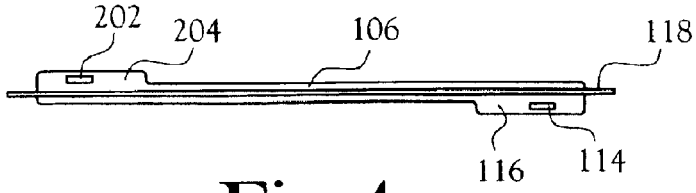
FIG. 4 is a bottom plan view of a flap from a pet door incorporating the lock mechanism of the present invention.

FIG. 4 illustrates a bottom plan view of one embodiment of the flap 106 showing the openings to the lock channels 114, 202 leading to the lock sockets 116, 204. Those skilled in the art will recognize that other configurations could be used without departing from the scope and spirit of the present invention. One such configuration would eliminate the channel and simply allow the bolt to rest against the flush surface of the flap face with only the socket area being raised above the surface of each flap face. With proper tolerances, the bolt will properly engage the socket without the need for a guide. In another embodiment, the thickness of the entire flap could be increased such that the flap face is flat at the level of the top of the socket area. This would require a channel to be formed in the flap face to allow the flap to move in one direction when the pet door is partially locked as described in relation to FIG. 6.

Figure 5:
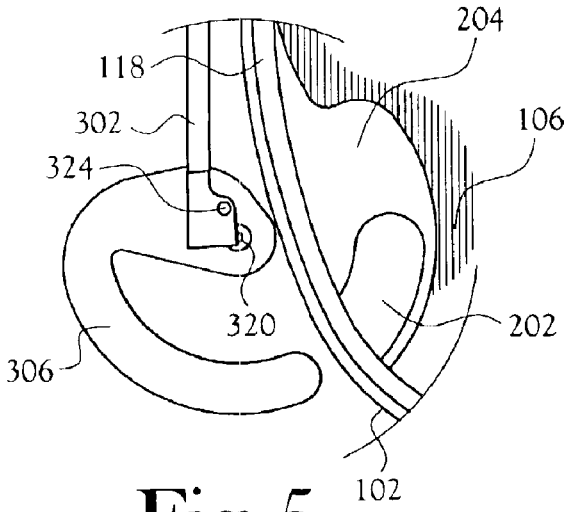
FIG. 5 is a front plan view of a lock mechanism of the present invention in a fully open position.
Figure 6:
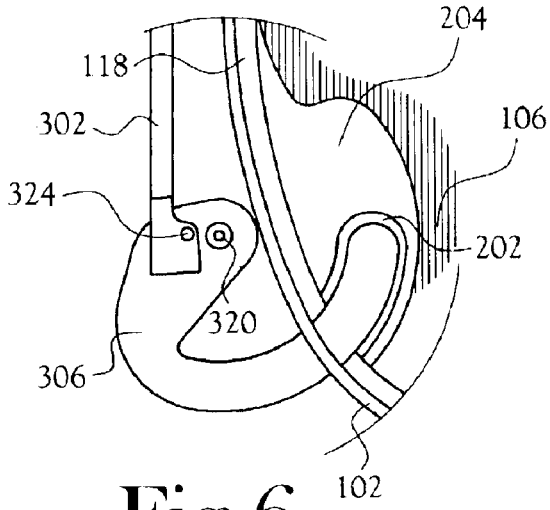
FIG. 6 is a front plan view of a lock mechanism of the present invention in an intermediate position restricting the movement of the flap in one direction.
Figure 7:
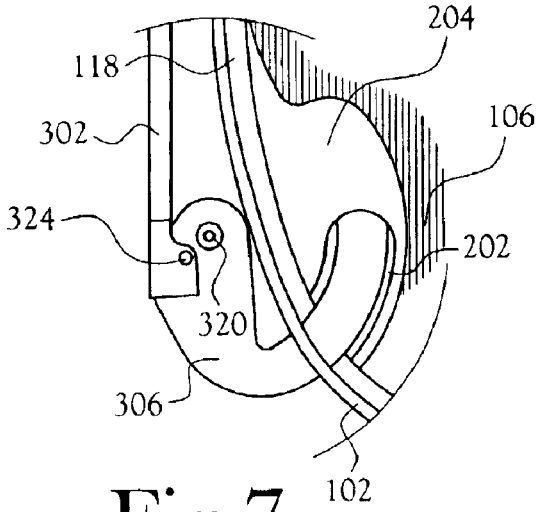
FIG. 7 is a front plan view of a lock mechanism of the present invention in a fully closed position.

FIGS. 5, 6, and 7 illustrate the three major positions of the bolt 304, 306 used to control ingress and egress. The operation of one bolt 306 is described; however, it will be recognized that two opposing bolts 304, 306 are used to full control over both ingress and egress. FIG. 5 illustrates the bolt 306 in the fully unlocked position. The bolt 306 is fully retracted into the inner frame member 100 and does not restrict movement of the flap 106 in either direction when a substantially perpendicular force is applied to the face of the flap 106.

FIG. 6 shows the bolt 306 moved in to the partially locked position in which the movement of flap 106 is restricted allowing passage through the passageway 104 in a single direction. The 306 bolt partially extends through the slot 299 in the passageway shelf 102 into the passageway 104 on one side of the flap 106, referred to as the bolt side for convenience. When an external force is applied substantially perpendicular to the bolt-side face of the flap 106, the flap 106 encounters no resistance and swings freely to allow movement through the passageway 104. However, when an external force is applied substantially perpendicular to the face of the flap 106 opposing the bolt side, the bolt-side face of the flap 106 is pushed against the bolt 306 extending into the passageway and movement is restricted. Accordingly, the flap 106 remains closed and ingress or egress, as appropriate, is denied.

FIG. 7 illustrates the bolt 306 moved into a fully locked position. The bolt 306 is fully extended through the slot 200 in the passageway shelf 102 and is inserted into the socket 204 in the flap 106. Because of the insertion of the bolt 306 into the socket 204, the flap 106 is held in place and restricted from swinging in either direction. Accordingly, both ingress and egress are denied, rendering the pet door 10 fully locked.

Figure 8:
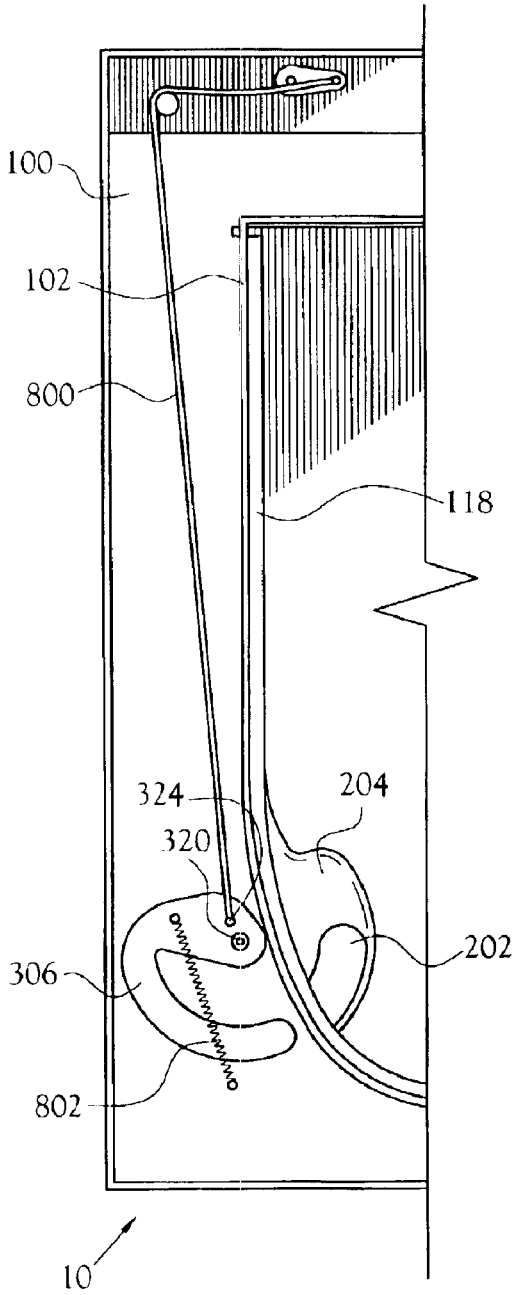
FIG. 8 is a rear elevation view of a pet door incorporating an alternate embodiment of the lock mechanism of the present invention in a fully open position.
Figure 9:
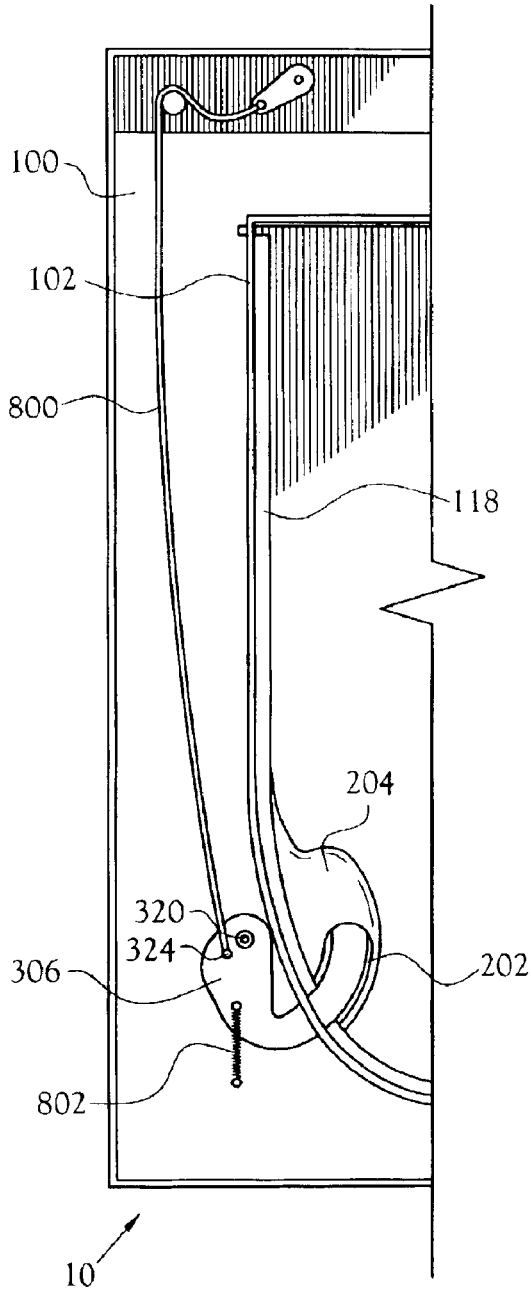
FIG. 9 is a rear elevation view of a pet door incorporating an alternate embodiment of the lock mechanism of the present invention in a fully closed position.

FIGS. 8 and 9 illustrates an alternate embodiment of the lock mechanism wherein the linkage 800 is a cable extending between the control 108, 110 and the bolt. Because the cable is inherently flexible, the need for a hinge in the linkage is eliminated. However, the use of a cable as the linkage 800 introduces other considerations. Depending upon the position of the control 108, 110, the cable 800 is either held under tension, as shown in FIG. 8, or in a relaxed state, as shown in FIG. 9. When taut, the cable 800 can exert a force sufficient to pivot the bolt 306 around the frame connector 320. Conversely, when relaxed, the cable 800 does not exert a force on the bolt 306. In order to move the bolt 306, a secondary force is required. In the illustrated embodiment, the secondary force is achieved through the use of a spring 802.

When the cable 800 is relaxed, the spring 800 operates to move the bolt 306 to a fully-locked position, i.e., the bolt 306 being received within the socket 204. This prevents movement of the flap 106 in the direction controlled associated with the bolt 306. When the cable 800 is pulled taut by operation of the control 110, the taut cable 800 operates on the bolt 306 to overcome the spring forces and retract the bolt 306 from the socket 204 thereby allowing the flap 106 to move freely. Those skilled in the art will recognize other methods for engaging and disengaging the bolt from the flap socket without departing from the scope and spirit of the present invention.

From the foregoing description, it will be recognized by those skilled in the art that a pet door has been provided that, in the foregoing embodiments, allows ingress and egress to be independently controlled. In addition, the pet door improves the accessibility of the lock mechanism controls. Further, the pet door reduces or eliminates the likelihood of accidentally changing the ingress and egress restrictions resulting from the pet making incidental contact with the controls while using the pet door.

While the present invention has been illustrated by description of several embodiments and while the illustrative embodiments have been described in detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A lockable pet door comprising:

a frame adapted to encompass an opening in a structural member, said frame defining a passageway;

a flap pivotably connected to said frame within said passageway, said flap being substantially rigid and having a first face and an opposing second face, said first face including a first socket, said second face including a second socket;

a first bolt adapted to be received within said first socket, said first bolt being movable to a unlocked position, a restricted position, and a locked position;

a first control that when operated moves said first bolt between said unlocked position, said restricted position, and said locked position;

a first linkage operably connecting said first control and said first bolt;

a second bolt adapted to be received within said second socket, said second bolt being movable to a unlocked position, a restricted position, and a locked position;

a second control that when operated moves said first bolt between said unlocked position, said restricted position, and said locked position;

a second linkage operably connecting said second control and said second bolt;

whereby said first control and said first bolt cooperate to control movement through said passageway in one direction and said second control and said second bolt cooperate to control movement through said passageway in an opposite direction.

2. The lockable pet door of claim 1 wherein, when in said unlocked position, said first bolt being fully retracted from said passageway and not obstructing movement of said flap, when in said restricted position, said first bolt extending into said passageway proximate said flap first face and obstructing movement of said flap in one direction, and, when in said locked position, said first bolt extending into said passageway and engaging said first socket to obstruct movement of said flap in both directions.

3. The lockable pet door of claim 1 wherein, when in said unlocked position, said second bolt being fully retracted from said passageway and not obstructing movement of said flap, when in said restricted position, said second bolt extending into said passageway proximate said flap second face and obstructing movement of said flap in one direction, and, when in said locked position, said second bolt extending into said passageway and engaging said second socket to obstruct movement of said flap in both directions.

4. The lockable pet door of claim 1 wherein said second bolt is in engagement with said second socket, said second socket releasing said second bolt when an external force is applied substantially perpendicular to said flap outer surface thereby permitting ingress through said passageway and said second bolt resisting movement of said flap when an external force is applied substantially perpendicular to said flap inner surface thereby restricting egress through said passageway.

5. The lockable pet door of claim 1 wherein each of said first linkage and said second linkage is a substantially rigid member, each of said first linkage and said second linkage defining a first section and a second section, said first section being hingably connected to said second section.

6. The lockable pet door of claim 1 wherein each of said first linkage and said second linkage is a cable, said first bolt and said second bolt being connected to said frame by a first spring and a second spring, respectively, said first spring and said second spring tensioned to return said first bolt and said second bolt, respectively, to said unlocked position, each of said first linkage and said second linkage operating against said first spring and said second spring, respectively, to move said first bolt and said second bolt to said restricted position and said locked position.

7. A lockable pet door comprising:

a frame defining a passageway;

a flap being substantially rigid having a first face and an opposing second face and adapted to swing freely within said passageway in a first direction and an opposing second direction, said flap including a first socket;

a first bolt movable between a first position, a second position, and a third position, wherein when said first bolt is in said first position, said first bolt does not obstruct said flap thereby allowing said flap to swing freely in both of said first direction and said second direction, wherein when said first bolt is in said second position, said first bolt obstructing said flap on one side thereby allowing said flap to swing freely in said first direction while being prevented from swinging in said second direction, when said bolt is in said third position, said first bolt engaging said first socket thereby preventing said flap from swinging in either of said first direction and said second direction;

a first control mounted on said frame, actuation of said first control moving said first bolt between said first position, said second position, and said third position; and a first linkage operably connecting said first control and said first bolt.

8. The lockable pet door of claim 7 wherein said first linkage is a cable, said first bolt being connected to said frame by a first spring, said first spring tensioned to return said first bolt to said third position, said linkage operating against said first spring to move said first bolt to either of said first position and said second position.

9. A lockable pet door comprising:

a frame defining a passageway;

a flap being substantially rigid having a first face and an opposing second face and adapted to swing freely within said passageway in a first direction and an opposing second direction;

a first bolt movable between a first position and a second position, wherein when said first bolt is in said first position, said first bolt does not obstruct said flap thereby allowing said flap to swing freely in both of said first direction and said second direction and wherein when said first bolt is in said second position, said first bolt obstructing said flap on one side thereby allowing said flap to swing freely in said first direction while being prevented from swinging in said second direction;

a second bolt movable between a first position and a second position, wherein when said second bolt is in said first position, said second bolt does not obstruct said flap thereby allowing said flap to swing freely in both of said first direction and said second direction and wherein when said second bolt is in said second position, said second bolt obstructing said flap on one side thereby allowing said flap to swing freely in said first direction while being prevented from swinging in said second direction;

a first control mounted on said frame, actuation of said first control moving said first bolt between said first position and said second position;

a second control mounted on said frame, actuation of said second control moving said second bolt between said first position and said second position;

a first linkage operably connecting said first control and said first bolt; and a second linkage operably connecting said second control and said second bolt.

10. The lockable pet door of claim 9 wherein said flap includes a second socket, said second bolt movable to a third position and, when in said third position, said second bolt engaging said second socket thereby preventing said flap from swinging in either of said first direction and said second direction, actuation of said second control moving said second bolt between said first position, said second position, and said third position.

11. A lockable pet door comprising:

a frame defining a passageway;

a flap being substantially rigid having a first face and an opposing second face and adapted to swing freely within said passageway in a first direction and an opposing second direction;

a first bolt movable between a first position and a second position, wherein when said first bolt is in said first position, said first bolt does not obstruct said flap thereby allowing said flap to swing freely in both of said first direction and said second direction and wherein when said first bolt is in said second position, said first bolt obstructing said flap on one side thereby allowing said flap to swing freely in said first direction while being prevented from swinging in said second direction, said first bolt being connected to said frame by a first spring tensioned to return said first bolt to said first position;

a first control mounted on said frame, actuation of said first control moving said first bolt between said first position and said second position; and a first linkage operably connecting said first control and said first bolt, said first linkage being a cable, said first linkage operating against said first spring to move said first bolt to said second position.

* * * * *